US008720123B1

(12) United States Patent
Katiraei

(10) Patent No.: US 8,720,123 B1
(45) **Date of Patent: *May 13, 2014**

(54) RAIN GUTTER SYSTEM FOR MOUNTING ATOP A ROOF

(71) Applicant: Arman Katiraei, Los Angeles, CA (US)

(72) Inventor: Arman Katiraei, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/076,249

(22) Filed: Nov. 10, 2013

Related U.S. Application Data

(63) Continuation of application No. 13/769,572, filed on Feb. 18, 2013, now Pat. No. 8,590,212.

(51) Int. Cl.
*E04D 13/00* (2006.01)

(52) U.S. Cl.
USPC ..... 52/15; 52/16; 52/24

(58) Field of Classification Search
CPC ..... E04D 13/064; E04D 13/0641
USPC ..... 52/15, 16, 24, 25, 667
See application file for complete search history.

(56) References Cited

U.S. PATENT DOCUMENTS

| | | | | | |
|---|---|---|---|---|---|
| 116,072 | A | * | 6/1871 | Lockwood | 52/15 |
| 268,881 | A | * | 12/1882 | Everson | 52/15 |
| 358,936 | A | * | 3/1887 | Krueger | 52/15 |
| 369,257 | A | * | 8/1887 | Martz | 52/25 |
| 462,847 | A | * | 11/1891 | Moon | 52/15 |
| 473,512 | A | * | 4/1892 | Laird | 52/25 |
| 490,815 | A | * | 1/1893 | Sims | 52/15 |
| 618,797 | A | * | 1/1899 | Manrow | 52/15 |
| 756,884 | A | | 4/1904 | Parry | |
| 827,456 | A | * | 7/1906 | Hazel et al. | 52/15 |
| 1,013,194 | A | * | 1/1912 | Mathes | 52/15 |
| 1,054,091 | A | * | 2/1913 | Darnall | 248/237 |
| 1,085,474 | A | * | 1/1914 | Peterson | 52/15 |
| 1,126,854 | A | * | 2/1915 | Graves et al. | 52/15 |
| 1,372,208 | A | * | 3/1921 | Statler | 52/96 |
| 1,480,261 | A | * | 1/1924 | Hacker | 52/15 |
| 1,498,351 | A | * | 6/1924 | Clement | 52/15 |
| 1,597,283 | A | * | 8/1926 | Murray | 52/15 |
| 2,270,537 | A | * | 1/1942 | Ludington | 52/173.1 |
| 2,270,538 | A | * | 1/1942 | Ludington | 52/15 |
| 2,582,515 | A | * | 1/1952 | Warp | 405/40 |
| 2,780,184 | A | * | 2/1957 | Olsson | 52/15 |
| 3,313,069 | A | * | 4/1967 | Jackson | 52/24 |
| 3,366,168 | A | * | 1/1968 | Dale | 165/47 |
| 3,431,972 | A | * | 3/1969 | Bernardi | 165/47 |
| 3,511,011 | A | * | 5/1970 | Straus | 52/478 |
| 3,617,691 | A | * | 11/1971 | Toyooka et al. | 219/201 |
| 3,967,419 | A | * | 7/1976 | Robinson | 52/16 |
| 4,072,285 | A | * | 2/1978 | Greenwood | 248/48.2 |

(Continued)

*Primary Examiner* — Basil Katcheves
*Assistant Examiner* — Joshua Ihezie

(57) ABSTRACT

A new rain gutter system includes a set of interlocked segments that are placed about perpendicular to the roof atop the roof. The segments create a channel that is angled from one edge of the roof to the other. The segments also create a non-permeable barrier at the intersection of the segments with the roof which causes the rain runoff running down the slope of the roof to be redirected into the channel and passed to one edge of the roof where it is deposited into a drain. The non-permeable barrier is established by laying a skirt that extends from the bottom of each segment upwards against the slope of the roof. The skirt can be inserted underneath the shingles, sealed with a sealant, or the end of the skirt can be thin enough to rest bare atop the roof and still provide a sufficient barrier.

20 Claims, 10 Drawing Sheets

(56) References Cited

U.S. PATENT DOCUMENTS

| | | | | | |
|---|---|---|---|---|---|
| 4,190,988 | A * | 3/1980 | Carreiro | 52/16 |
| 4,432,341 | A * | 2/1984 | Howe et al. | 126/623 |
| 5,414,965 | A * | 5/1995 | Kelley et al. | 52/60 |
| 5,588,261 | A * | 12/1996 | MacConochie | 52/11 |
| 5,678,359 | A * | 10/1997 | Turner | 52/12 |
| 5,890,324 | A * | 4/1999 | Maanum | 52/24 |
| 6,273,640 | B1 * | 8/2001 | Suazo | 405/121 |
| 6,692,186 | B1 * | 2/2004 | Suazo et al. | 405/36 |
| 7,905,061 | B2 * | 3/2011 | Kaiser et al. | 52/84 |
| 8,152,112 | B2 * | 4/2012 | Miller et al. | 248/48.1 |
| 8,590,212 | B1 * | 11/2013 | Katiraei | 52/15 |
| 2004/0255522 | A1 * | 12/2004 | Knudson et al. | 52/11 |
| 2006/0248810 | A1 * | 11/2006 | Ewing | 52/84 |
| 2007/0113489 | A1 * | 5/2007 | Kaiser et al. | 52/84 |

* cited by examiner

RAIN GUTTER SYSTEM FOR MOUNTING ATOP A ROOF

CLAIM OF BENEFIT TO RELATED APPLICATIONS

This application is a continuation of United States non-provisional application Ser. No. 13/769,572, entitled "Rain Gutter System for Mounting Atop a Roof", filed Feb. 18, 2013. The contents of application Ser. No. 13/769,572 are hereby incorporated by reference.

TECHNICAL FIELD

The present invention pertains to rain gutters for homes and buildings with sloped roofs.

BACKGROUND

The rain gutter system is an essential component for any home or building. The rain gutter system collects rain runoff from the entire surface area of the building's roof and transfers the runoff to a drainage system. Without a properly functioning rain gutter system, that same runoff is forced to the edge of the roof where it then falls onto the grounds adjacent to the building. This can obstruct visibility through windows underneath the roof edge and also produce excessive noise as the rain runoff aggregates into larger droplets or flows of water that drop from the roof to the ground adjacent to the building. Worse yet, rain runoff that is not properly redirected to drainage systems can result in flooding as the aggregate rain from the surface area of the roof is pooled to a much smaller area in the grounds adjacent to the building. This can cause damage to the foundation of the building and ruin landscaping. Beyond these functional roles, rain gutter systems also serve an aesthetic purpose to some by providing a bordering to the roof.

Rain gutter systems for homes and other buildings with sloped roofs have not changed for several decades. The standard rain gutter system involves U-shaped channels that overhang from the edge of the roof and that collect the rain runoff. The channels are interconnected at a slope so as to force the collected rain runoff to one end of the channel where the rain runoff is funneled into an enclosed channel that spans the vertical height of the home or building. The enclosed channel then redirects the rain runoff into a drainage system or other plumbing that moves the water away from the home.

While effective in their roles, these systems are in need of radical redesign to lower the cost of goods, reduce installation time and cost, and provide an alternative in building aesthetics. With regards to the cost of goods, standard overhanging rain gutter systems are produced with an unnecessary amount of raw materials. Specifically, the U-shaped channels that funnel the rain runoff from the roof are three-sided segments. Each three-sided segment includes material for a right lateral side, a left lateral side, and a bottom side with the material comprising either metal, aluminum, or hardened plastic. Therefore, one way to lower the cost of goods associated with standard rain gutter systems is to provide a redesigned system that does not need as many raw materials or, more specifically, provide a redesigned system that performs the same functional roles with a two-sided or single-sided channel. In so doing, the cost of the raw materials needed for a gutter system is effectively reduced by a half or two-thirds.

With regards to installation time and cost, installation of a standard overhanging rain gutter is normally beyond the capabilities of the typical do-it-yourselfer and requires a contractor or one or more handymen to perform the installation. This is because of the danger that is involved in installing any structure to the edge of a roof irrespective of the fact that the channels are heavy and require one person to hold the channel in place while another secures the channel to the roof. Installation is also time-consuming because several brackets must be drilled, nailed, or otherwise secured to the roof in order to support the weight of the channels spanning the entire width of the roof. Moreover, overhanging rain gutters can damage the roof itself as water can enter through the mounting points of the brackets and thereby seep into and damage the underlying wood framework for the roof. Also, the brackets must be precisely installed so as to support the channels at an appropriate angle, thereby producing the slope by which gravity pulls the collected rain runoff to one end of the channel. An unforeseen cost is also the time or money needed to clear these systems from leaf and other debris buildup that could otherwise clog or render such systems ineffective. Every so often, someone has to remove such blockages from the channels. This can be done by the building owner with a ladder, but the time required to do so is nevertheless a cost.

As architecture has evolved, the standard rain gutter system has not. With regards to aesthetics, the look of the overhanging gutter system has become so commonplace that it is either ignored or viewed as an eyesore by some. Consequently, the standard rain gutter system simply does not conform aesthetically with the architecture or other design elements of some homes or buildings.

Accordingly, there is a need for an entirely new and improved rain gutter system. Such a system should be cheaper to manufacture, easier to install, and provide a different aesthetic on the home or building that is installed with such a system. Moreover, these advantages should be achieved without other tradeoffs with respect to effectiveness in removing rain runoff from the roof and without the introduction of other costs in maintenance, repair, or damage caused to the home or building that is installed with the rain gutter system.

SUMMARY OF THE INVENTION

It is an objective of the present invention to provide an alternative to standard overhanging rain gutter systems found on nearly every home and building with a sloped roof. It is further an objective to provide an alternative rain gutter system that is cheaper to manufacture, easier and less time consuming to install, and one that provides a different aesthetic to the standard overhanging rain gutter system. Moreover, it is an objective to provide these and other benefits without detrimentally affecting the functionality of the rain gutter system in effectively redirecting and removing rain runoff from a roof.

To achieve these and other objectives, a new rain gutter system is provided that takes advantage of the existing configuration of a sloped roof in order to minimize the raw materials that are needed to create a channel to redirect rain runoff, simplify the installation, and provide a new aesthetic to the building that is different than that provided by any overhanging rain gutter system. The system includes a set of interlocked segments that are placed about perpendicular to the roof atop the roof. The segments create a horizontal channel that is slightly angled from one edge of the roof to the other. The segments also create a non-permeable barrier at the intersection of the segments with the slope of the roof which causes the rain runoff running down the slope of the roof to be redirected into the channel and passed to one edge of the roof where it is deposited into a drain. The end segment may include a receptacle and a spigot that collects the runoff and redirects the runoff into a vertical drain.

The non-permeable barrier is established by laying a waterproof skirt that extends from the bottom of each segment upwards against the slope of the roof. The skirt can be inserted underneath the shingles or sealed with a sealant to establish the non-permeable barrier. Alternatively, some embodiments create the end of the skirt thin enough such that it may be allowed to rest bare atop the roof and still provide a sufficient non-permeable barrier.

Installation for such a system is simplified because only the end segments at either edge of the roof need to be secured to the roof. The intermediary segments are held in place by interlocking with one another and with the end segments using a male-female coupling mechanism. As such, the roof is only modified when securing the two end segments to the roof using nail, screws, clamps, or other securing mechanisms. Cost is also reduced when compared to traditional overhanging gutter systems. The system described herein requires fewer raw materials as it foregoes the need for a three sided "U" shaped channel to redirect the rain runoff. Instead, the system leverages a two sided "V" shaped channel, wherein one of the sides is the roof itself.

BRIEF DESCRIPTION OF THE DRAWINGS

In order to achieve a better understanding of the nature of the present invention, various embodiments of the new rain gutter system will now be described, by way of example only, with reference to the accompanying drawings in which.

DETAILED DESCRIPTION OF THE INVENTION

In the following detailed description, numerous details, examples, and embodiments of the new rain gutter system are set forth and described. As one skilled in the art would understand in light of the present description, the system is not limited to the embodiments set forth, and the system may be practiced without some of the specific details and examples discussed. Also, reference is made to accompanying figures, which illustrate specific embodiments in which the invention can be practiced. It is to be understood that other embodiments can be used and structural changes can be made without departing from the scope of the embodiments herein described.

The rain gutter system advocated herein does away with the traditional overhanging rain gutter and replaces this effective but costly and time consuming standard with a simple, minimalistic, and unobtrusive design. This new design takes advantage of the existing configuration of a sloped roof in order to minimize the raw materials that are needed to create a channel to redirect rain runoff, simplify the installation, and provide a new aesthetic to the building that is different than that provided by any overhanging rain gutter system. In summary, the design integrates the roof as part of the rain gutter system.

Figure 1:
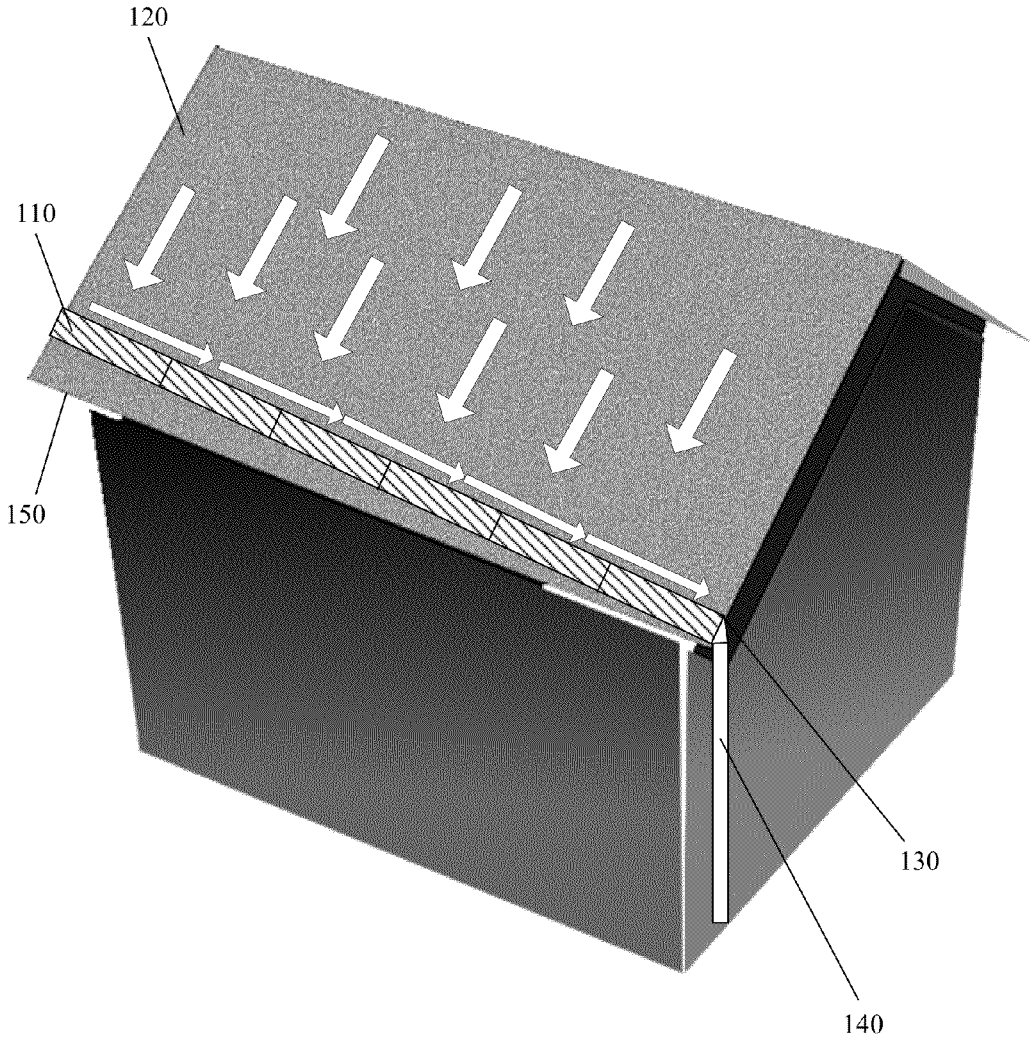
FIG. 1 illustrates the new rain gutter system in accordance with some embodiments.

FIG. 1 illustrates the new rain gutter system in accordance with some embodiments. The system works by affixing a set of interlocking segments 110 about perpendicular to the roof 120 and by angling the segments to form a channel that forces rain water to one edge 130 of the roof where a vertical drain 140 then removes the water. Once rain water contacts the roof 120, gravity forces the water down the slope of the roof 120 until it contacts the gutter segments 110. The segments 110 form a non-permeable barrier with the roof 120. This barrier prevents the water from seeping past the segments 110 and from reaching the ledge 150 of the roof 120. Instead, the water is redirected along the channel that is formed by the perpendicular intersection of the segments 110 and the roof 120. The water then collects at the edge 130 of the roof 120 and is fed into the vertical drainage system 140. The vertical drainage system may be the same or similar to those used for standard overhanging gutters.

This design provides several benefits over the traditional overhanging rain gutter systems of the prior art. Firstly, cost of materials is reduced. The parts of the new system include single-sided or inverted "V" shaped segments in contrast to the three-sided U-shaped channels of an overhanging rain gutter system. Accordingly, the parts for the new rain gutter system are easier to manufacture and constitute fewer raw materials, making them far cheaper to mass produce. Secondly, installation of the new rain gutter system is greatly simplified relative to traditional overhanging rain gutter system. This new system requires only two points of installation at a minimum. The first installation point is at one edge of the roof where a first end segment is anchored to the roof and the second installation point is at the opposite edge of the roof where a last end segment is anchored to the roof. All segments in between are supported by interlocking directly or indirectly with these two anchor segments. In other words, an installer need only drill holes, nail, or otherwise secure the anchoring end segments to the roof. The rest of system is interconnected without further modification to the roof. Thirdly, the new rain gutter system provides an entirely different aesthetic to the building. The height of the segments can be as low as one inch so that the entire system is almost imperceptible from a distance. In this manner, the new gutter system does not interfere with the architecture of the building or other design elements of the building as would a traditional overhanging rain gutter system. Fourthly, the new gutter system is less susceptible to clogging and the cleaning of the new gutter system is far simpler than traditional overhanging gutter systems. In fact, the new gutter system effectively cleans itself by using the rain the runoff to channel fallen leaves and other debris away from the channel and over a side of the roof.

The new rain gutter system is comprised of a start anchor segment, a plurality of intermediary segments, and an end anchor segment. The segments (i.e., start, intermediary, and end) interlock with one another in order to form a channel of sufficient width to accommodate roofs of different sizes.

Figure 2:
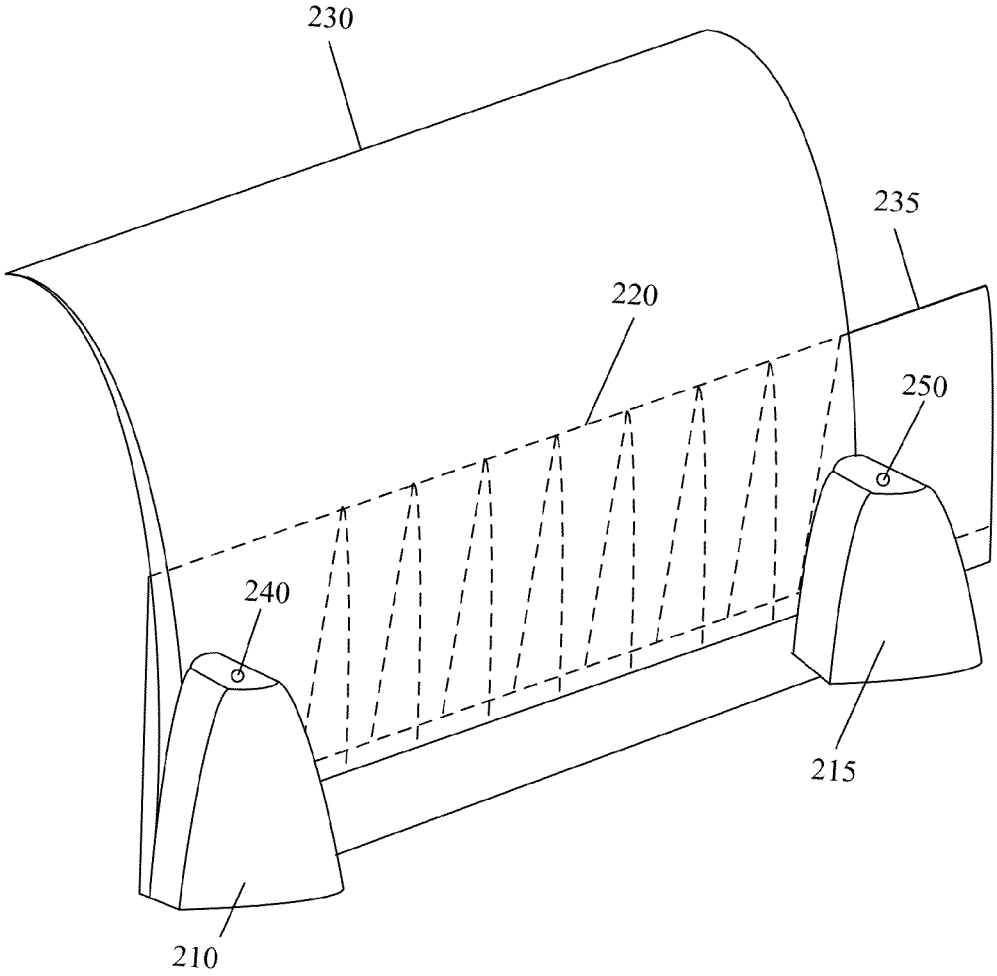
FIG. 2 illustrates the components of the start anchor segment and the end anchor segment.

FIG. 2 illustrates the components of the start anchor segment and the end anchor segment. The start anchor segment and end anchor segment are structurally similar in that they include anchor blocks 210 and 215, body 220, outer membrane 230, and interlocking element 235. The intermediary segments are structurally similar to the anchor segments except that they need not include any anchor blocks and they provide interlocking elements at either end of the segment. The structure of the intermediary segments will be clarified below.

The start anchor segment and the end anchor segment are the end pieces of the gutter system. As such, these segments are located at either the right edge or the left edge of the roof. These segments establish the position and angle of the entire gutter system and may be the only two segments that are physically secured to the roof, thus making installation of the entire rain gutter system easy and efficient. Additional anchor blocks may be used for added support when the roof is excessively wide or as will be discussed below, some of the intermediary segments may include an anchor block for additional support. The start anchor segment is vertically offset and positioned higher on the roof than the end anchor segment. The intermediary segments interlock in between the start and end anchor segments to create the angle for the gravity assisted channel that leads rain runoff to drainage. An installer will typically secure the position of the end anchor segment first before securing the start anchor segment and before interlocking the intermediary segments. The installer will want the end anchor segment to align with the vertical drain so that the collected rain runoff is directed from the gutter system into the vertical drain.

Figure 3:
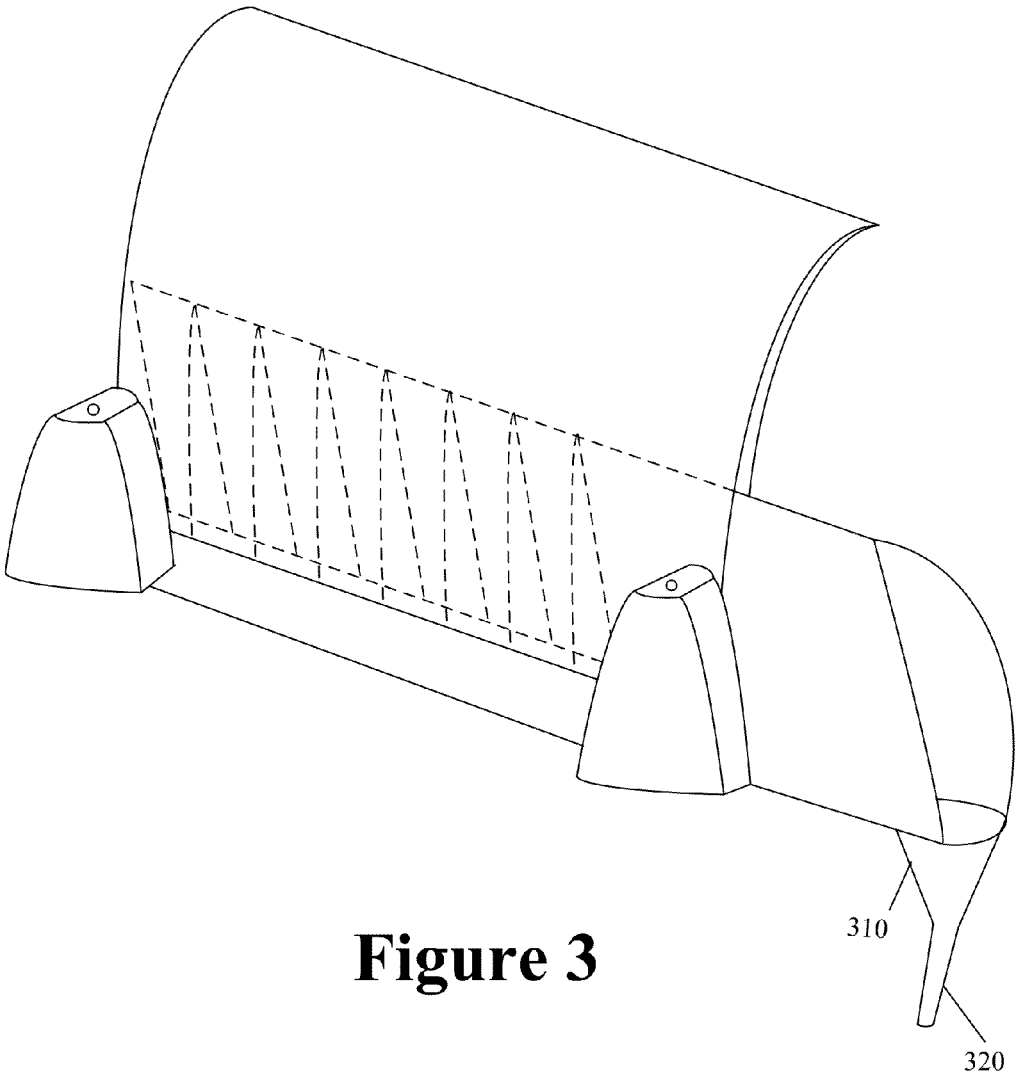
FIG. 3 illustrates the end anchor segment of some embodiments with a funnel shaped receptacle and a spigot.

As shown in FIG. 3, the end anchor segment of some embodiments includes a funnel shaped receptacle 310 and a spigot 320. The receptacle 310 extends away from the anchor blocks thereby allowing the receptacle 310 to hang over the side of the roof. The receptacle 310 collects the horizontally flowing rain runoff from the channel and redirects the rain runoff to the spigot 320. The spigot 320 is vertically disposed at the bottom of the receptacle 320. In some embodiments, the spigot 320 is flexible rubber hosing. The flexible rubber hosing allows the installer to position the hosing in any vertical drain that runs along the vertical length of the building. This simple positioning of the hosing into the vertical drain is sufficient to cause the rain runoff to enter the vertical drain. In some embodiments, the spigot 320 is shaped as a nipple over which rubber hosing or PVC piping can be fitted. This allows the installer to create a vertical drain cheaply using the aforementioned rubber hosing or PVC piping, either of which can be easily worked with to run the vertical length of the building to a sewer system or ground drain.

The start anchor segment should be elevated with at least a three degree angle from the position of the end anchor segment. The steepness of the angle determines the rate at which rain runoff is channeled off the roof. Accordingly, a larger angle may be used for locations that receive greater amounts of sustained rainfall and where faster drainage is desired. However, there is no hard and fast rule for this angle or the offset between the start and end anchor segments. This further simplifies the installation as the installer can proceed with the installation quickly without the need for measuring.

The anchor blocks 210 and 215 provide the means by which to secure either a start anchor segment or end anchor segment to the roof. As shown, the first anchor block 210 is located behind the segment at a proximal end and the second anchor block 215 is located behind the segment at a distal end. The anchor blocks 210 and 215 are solid structures containing a receptacle (see reference markers 240 and 250). Each anchor block 210 and 215 can be made from hardened rubber or plastic. Each receptacle 240 and 250 may include an unthreaded hole through which a nail passes or a threaded hole through which a screw passes. The two nails or screws are longer in length than the length of the anchor blocks 210 and 215 so as to pass through the entire length of the segment and penetrate into the roof. The two nails or screws establish and maintain the position and angle at which the start or end anchor segment is secured to the roof.

Installation is therefore as simple as positioning the anchor segment at an end of the roof at a desired angle and hammering in two nails or driving in two screws into the roof to affix the position of the anchor segment to the roof. This results in much quicker installation time, much easier installation, and far less physical modification to the roof than required for the installation of traditional overhanging gutter systems.

Figure 4:
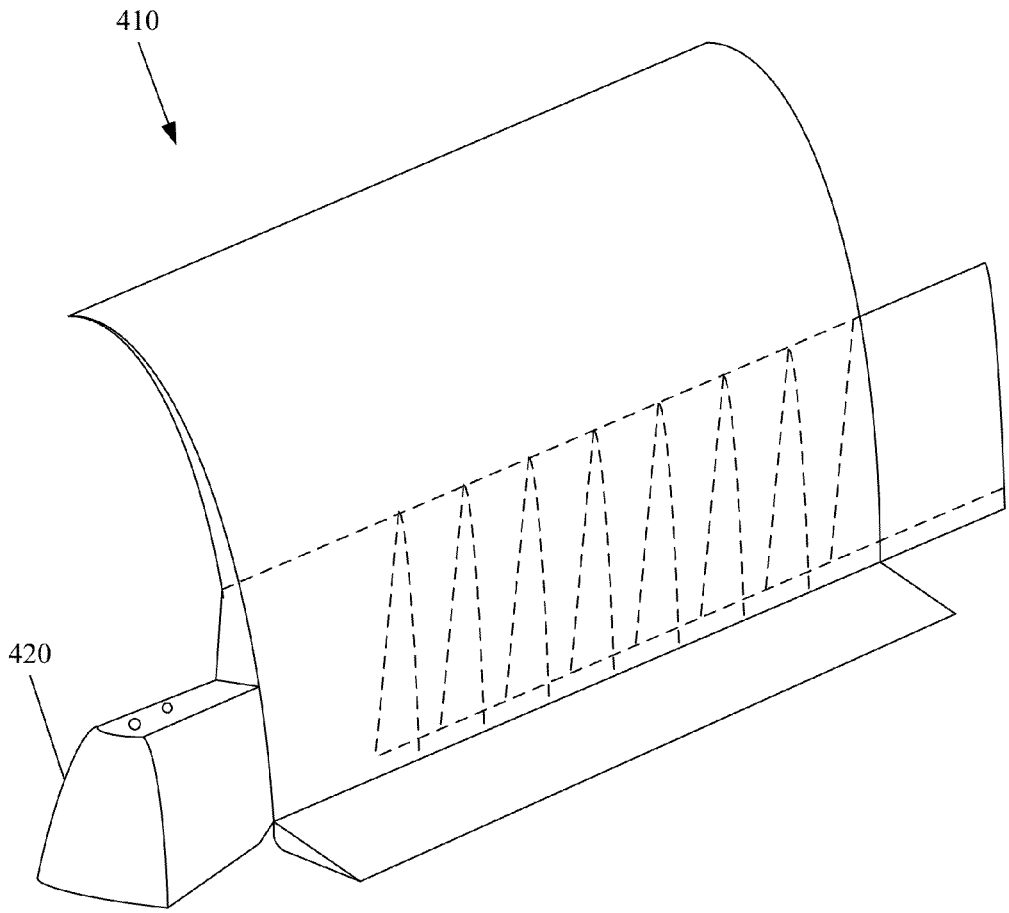
FIG. 4 illustrates an anchor segment in accordance with some embodiments, wherein the segment includes a single anchor block that is affixed to one end of the segment.

Some embodiments provide start and end anchor segments with different anchor blocks than those described above. For example, FIG. 4 illustrates an anchor segment 410 in accordance with some embodiments, wherein the segment includes only one anchor block 420 that is affixed to one end of the segment. The anchor block 420 includes two holes for securing the segment to the roof. In some such embodiments, the anchor block 420 may be modified with three or more receptacles with each additional nail or screw providing further support in retaining the angle and position of the anchor segment when secured to the roof. For instance, a first receptacle may be located at a distal end of the anchor block and second and third receptacles are located at a proximal end of the anchor block and are offset from the first receptacle by a horizontal distance with the second receptacle being vertically offset though in parallel with the third receptacle, thereby providing a greater stabilizing force for the entire gutter system when secured to the roof.

In still some other embodiments, the anchor block can be an adjustable bracket that can be resized to clamp to an outer beam below the surface of the roof. Nails or screws can be used to secure the clamp to the beam. In some such embodiments, the bracket includes an inner shaft that slides in to and out from an outer shaft to adjust a height of the bracket. The inner shaft contains a series of holes that align with a hole on the outer shaft when the inner shaft is slid in and out of the outer shaft. A pin or screw mechanism inserted through a hole along the inner shaft that is aligned with the hole of the outer shaft sets the height of the bracket. A similar inner shaft and outer shaft combination can be used to set the width of the bracket. These adjustments allow the anchor block to clamp to beams of varying sizes that run underneath the roof surface. Receptacles along the bracket receive nails or screws in order to secure the position and angle of the start or end anchor segment to the roof.

With reference back to FIG. 2, the body 220 of any of the segments (i.e., start anchor, end anchor, and intermediary) is a rigid inner framework that defines and retains the shape of the segment. In some embodiments, the body 220 is an inverted "V" shaped frame. The frame can be constructed from rigid metals, rigid plastics, or composite materials. For instance, the frame can be constructed from steel, aluminum, hardened plastic, or graphite. The rigidity of frame is necessary to preserve the shape of the gutter system channel when each of the segments is interlocked with one another. In other words, the frame is of sufficient rigidity so as to provide minimal or no bend or flex when interlocked with other segments. The inverted "V" shape for the frame also acts to prevent slippage or movement of the segment when impacted by the force of rain runoff, though the segment primarily derives its static positioning by directly or indirectly interlocking to the secured start and end anchor segments. Some other embodiments replace the inverted "V" frame with a single planar structure.

In some embodiments, the body 220 rises one inch vertically. At one inch in height, the segments of the gutter system are nearly imperceptible from a distance. However, other embodiments provide for a body 220 that rises anywhere from half an inch to six inches in height. The height of the body 220 determines the amount of rain runoff that can be carried by the channel at any given moment. Therefore, a body 220 having a height greater than one inch would be better suited for locations that receive heavy sustained rainfall, wherein at such locations, the aggregate rain runoff collected at any position along the channel may reach over one inch in height. In other words, the height of the body 220 acts as a dam that holds the rain runoff from reaching the roof ledge, with the angle of the segments creating the necessary force to redirect the rain runoff to the roof edge where a drainage system removes the water from the roof. In some embodiments, the body 220 of each segment is one to five feet in width. Though, shorter and greater widths can be manufactured to allow the gutter system to fit the width of any roof segment by up to one foot.

In order to interlock the segments, the body 220 of a start or end anchor segment includes interlocking element 235 at one end, while the intermediary segments include an interlocking element 235 at either end of the segment. In the case of a start anchor segment, the interlocking element 235 can be a male coupler with the end anchor segment having the complimentary female coupler or vice versa. In the case of the intermediary segment, the segment includes a male coupler at one end and a female coupler at the other end. Any number of male-female coupling mechanisms can be used to interlock the segments. Some examples will now be given. However, these examples are not intended to be exhaustive or limiting and it should be apparent to one of ordinary skill in the art that other interlocking mechanisms can be used.

In some embodiments and as shown in FIG. 2, the male coupler is an extension of the body frame 235 that extrudes from the first end of the segment. For such embodiments, the female coupler comprises an empty cavity at the second opposite end of the segment. To interlock a first and second segment, the extruding frame segment for the male coupler of the first segment is slid into the female coupler of the second segment and when the extruding frame segment of the first segment abuts the frame of the second segment, the segments become interlocked. Also, the first segment is prevented from sliding further into the second segment because of the abutment of the frames.

Figure 5:
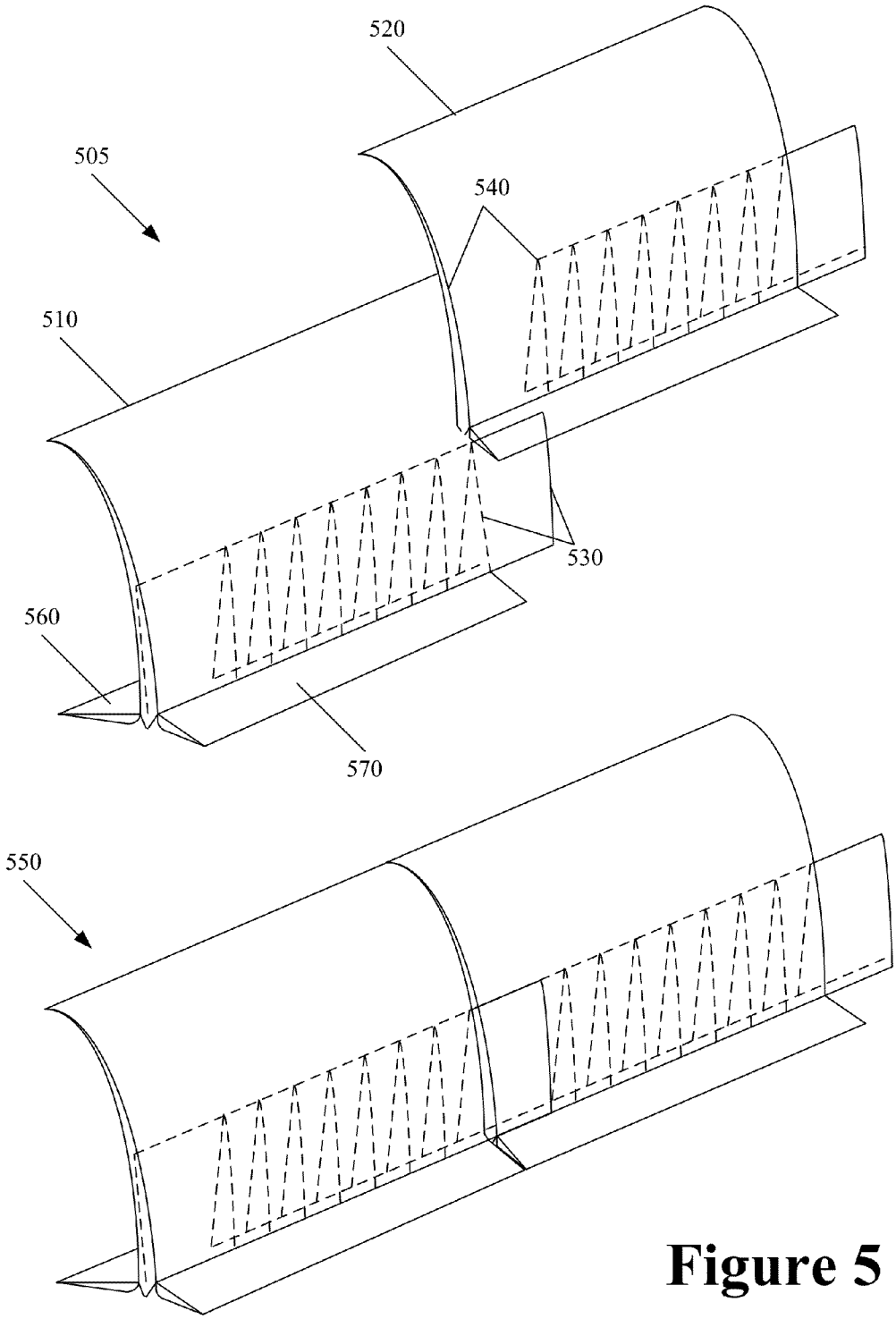
FIG. 5 illustrates interlocking two adjacent segments in accordance with some embodiments.

FIG. 5 illustrates interlocking two adjacent segments 510 and 520 in accordance with some embodiments. At 505, the extruding male coupler 530 of segment 510 is aligned over the female coupler 540 of segment 520. Once aligned, the segment 520 is lowered at 550 such that the male coupler 530 of segment 510 inserts in the female coupler 540 of segment 520, thereby interlocking the two segments 510 and 520.

Figure 6:
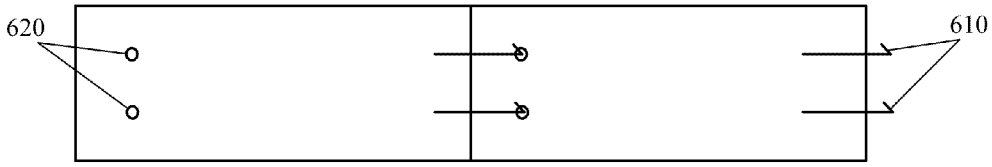
FIG. 6 illustrates a pronged male-female coupling mechanism for interlocking segments in accordance with some embodiments.
Figure 7:
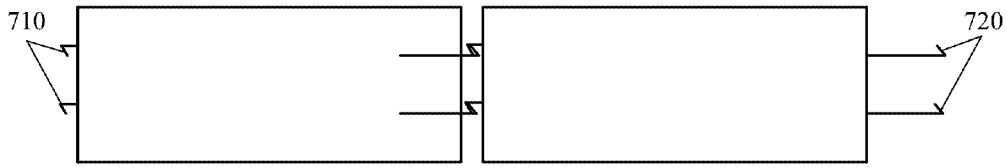
FIG. 7 illustrates an alternative pronged male-female coupling mechanism for interlocking segments in accordance with some embodiments.

In some embodiments as shown in FIG. 6, the interlocking mechanism includes a male coupler with a pair of prongs 610 that extend out and away from the body towards the first end. The complimentary female coupler includes a pair of holes 620 towards the second end into which the prongs of the male coupler fit. The prongs of the male coupler are inserted into the holes of the female coupler, thus interlocking the two segments together. Alternatively as shown in FIG. 7, the female coupler may include opposite facing prongs 710 that interlock with the prongs 720 of the male coupler.

Figure 8:
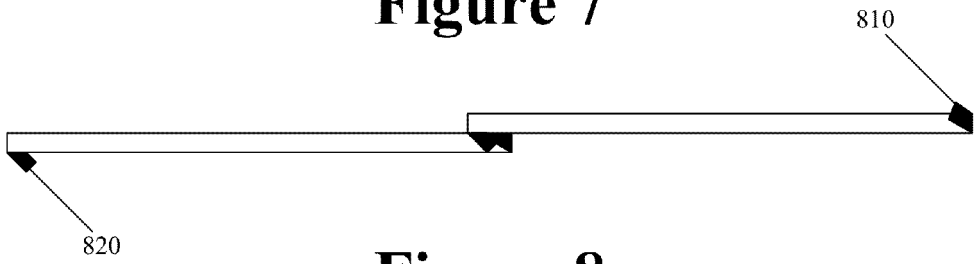
FIG. 8 illustrates from a top view, an interlocking mechanism that utilizes angled protrusions in accordance with some embodiments.

FIG. 8 illustrates from a top view, an interlocking mechanism that utilizes angled protrusions in accordance with some embodiments. In FIG. 8, the male coupler is an angled protrusion 810 that extends inward behind the body at the distal end and the female coupler is an angled protrusion 820 that extends inward in front of the body at the proximal end. Accordingly to interlock a first segment with a second segment, the second segment is brought behind the first segment and moved such that the male coupler of the first segment engages the female coupler of the second segment.

Figure 9:
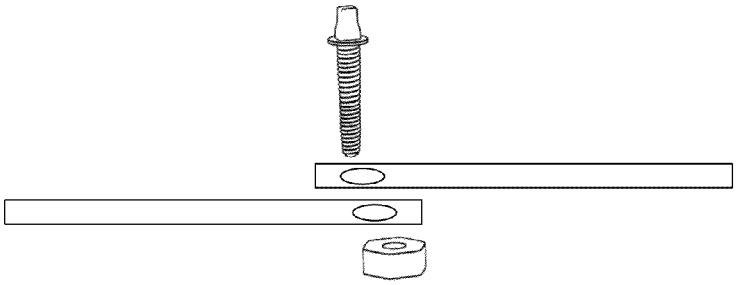
FIG. 9 illustrates yet another interlocking mechanism using a nut and bolt assembly.

FIG. 9 illustrates yet another interlocking mechanism using a nut and bolt assembly. This interlocking mechanism relies on manufacturing the body of the segments with one or two holes at each of the distal and proximal ends. During installation, the holes at the distal end of a first segment are aligned with the holes at the proximal end of a second segment. A bolt is then slid through the aligned holes and a nut is secured to the bolt, thereby interlocking the two segments.

With reference back to FIG. 2, shrouding each segment is the outer membrane 230. In some embodiments, the outer membrane 230 bends in a concave shape towards the apex to form the rain runoff containing channel. In some other embodiments, the outer membrane 230 is not curved but straight. The outer membrane 230 is made of a non-permeable material that envelopes the body 220. The non-permeable material is typically a flexible plastic or rubber based material that is waterproof and weather resistant. The non-permeable material is selected to withstand cracking and other deformation from direct sun, freezing temperatures, as well as rain, snow, and other outside elements. The non-permeable material can range in thickness, but is preferably a few millimeters thick.

Figure 10:
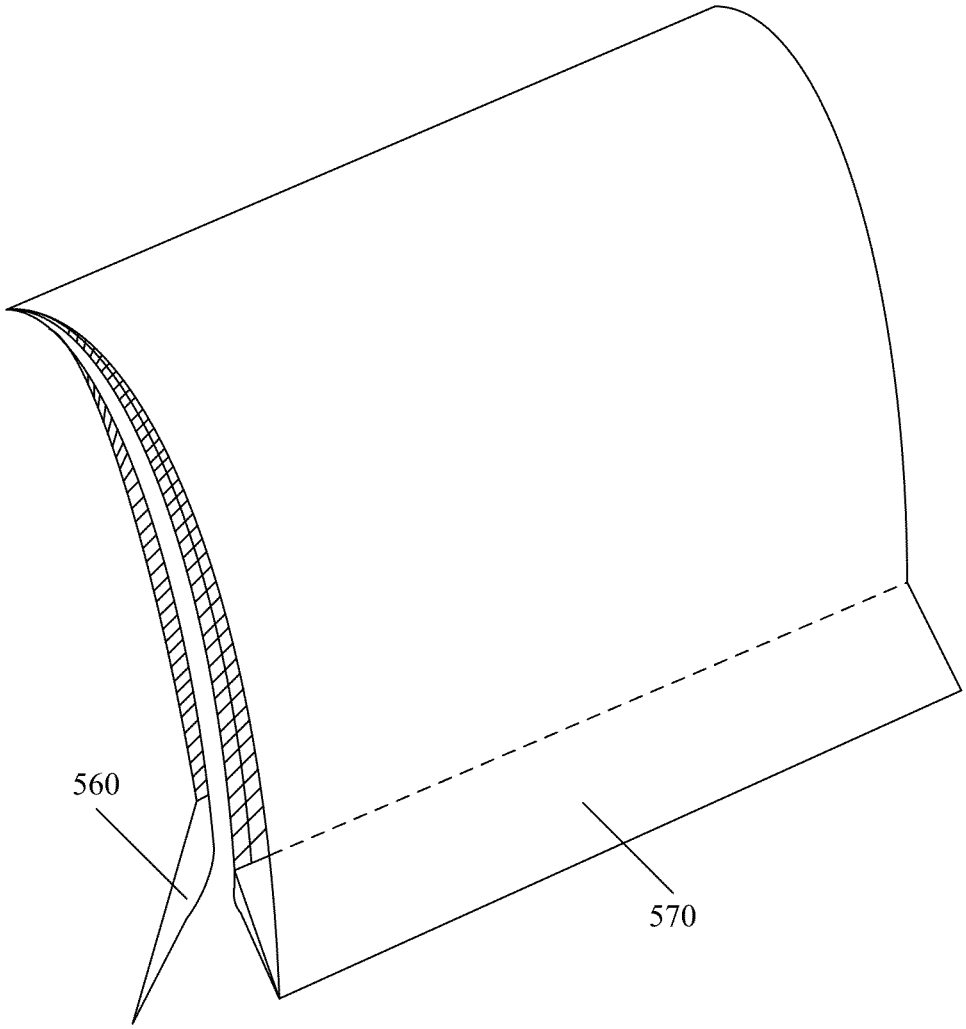
FIG. 10 illustrates the first skirt and second skirt of a segment in accordance with some embodiments.

The outer membrane 230 is wedge shaped and is a singular piece at the apex. Some distance below the apex, the outer membrane 230 splits to provide a central cavity within which the rigid frame of the body 220 is housed. The outer membrane 230 extends below the body for some distance and forms two skirts. FIG. 5 and FIG. 10 illustrate the first skirt 560 and second skirt 570 of a segment in accordance with some embodiments.

When a segment is placed perpendicular to a roof, each skirt flexes outward from the center of the segment. A first skirt flexes outward toward the apex of the roof and a second skirt flexes outward towards the ledge of the roof.

Figure 11:
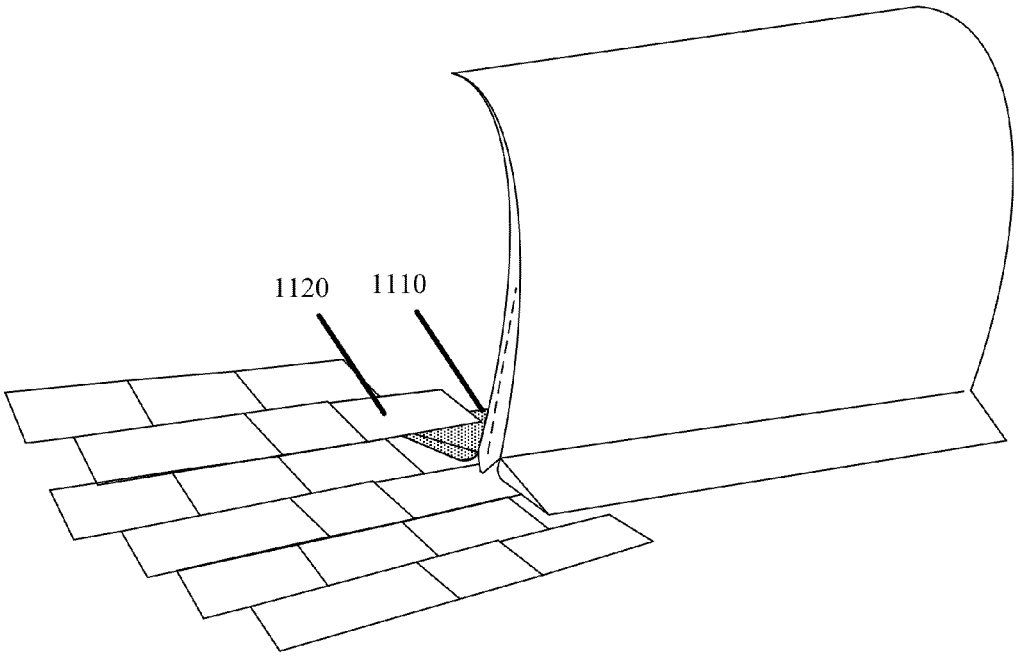
FIG. 11 illustrates sliding the first skirt underneath a row of roof shingles during installation.

The first skirt sits flush against the roof and causes rain runoff to flow from the roof shingles over to the skirt and collect in the channel of the corresponding segment. The first skirt thereby creates a barrier that prevents rain runoff from running underneath and past the segments. In some embodiments and as shown in FIG. 11, the first skirt 1110 is slid underneath a row of roof shingles 1120 during installation. This installer is merely required to lightly lift the row of shingles in front of the first skirt and slide the edge of the first skirt underneath. This forms a tight seal that prevents rain runoff from passing underneath the segments since the rain runoff will flow over the shingles, onto the first skirt, and with the assistance of gravity, across the channel over the outer membrane of the interlocked segments. Additionally or alternatively, once the segments have been interlocked and placed on the roof, a waterproof sealant can be applied at the intersection of the first skirt and the roof. The waterproof sealant can be applied irrespective of whether the first skirt is slid underneath the roof shingles or is left atop the shingles. The waterproof sealant can include waterproof silicon or caulk as some examples. The sealant further serves to prevent rain runoff from passing underneath the first skirt. The sealant also does not physically modify the roof and can be easily removed using a blade without damage to the roof or its shingles. In some embodiments, the lip or edge of the first skirt is thin enough (a few millimeters) that is able to rest bare atop the roof and still create a sufficient non-permeable barrier that prevents a majority of the rain runoff from passing underneath or past the first skirt. In other words, once the first skirt is laid atop the roof, the water will run down the slope of the roof until it contacts the first skirt. The path of least resistance for the water is then to flow over the first skirt (not under) and into the channel created by the interlocked bodies of the segments where it is then redirected to the end anchor segment. As such, the first skirt need not be inserted underneath the shingles or sealed with a sealant, though such acts would improve the seal between the roof and first skirt.

The second skirt also sits flush against the roof. The primary purpose of the second skirt is to buttress the position of the segment and provide friction to prevent movement of the segment along the roof. Secondarily, the second skirt acts as a second seal to prevent any rain runoff that passes under the first skirt from passing past the segment. Instead, an unseen second channel is formed in between the inverted "V" frame of the body.

In some embodiments, the second skirt is omitted such that only the side of the segment that points towards the roof apex is housed with the non-permeable membrane. In some such embodiments, the entire body of the segment is not shrouded by the non-permeable membrane.

In some embodiments, the width of each of the first and second skirts is greater than the width of the body so as to provide overlap when one segment interlocks with another. This provides a continuous channel over which rain runoff will flow until it reaches the drain at the end anchor segment. Specifically, when the interconnection of the segments is achieved by placing one segment over an extruding male coupler of another segment, the skirts for the top segment will overlap and partially cover the skirts of the underlying segment. When the top segment is up-channel and the underlying segment is down-channel, that rain runoff will flow from the top segment to the underlying segment and the overlap of the skirts will retain the rain runoff wholly within the channel without the need of any additional sealant or waterproofing.

Figure 12:
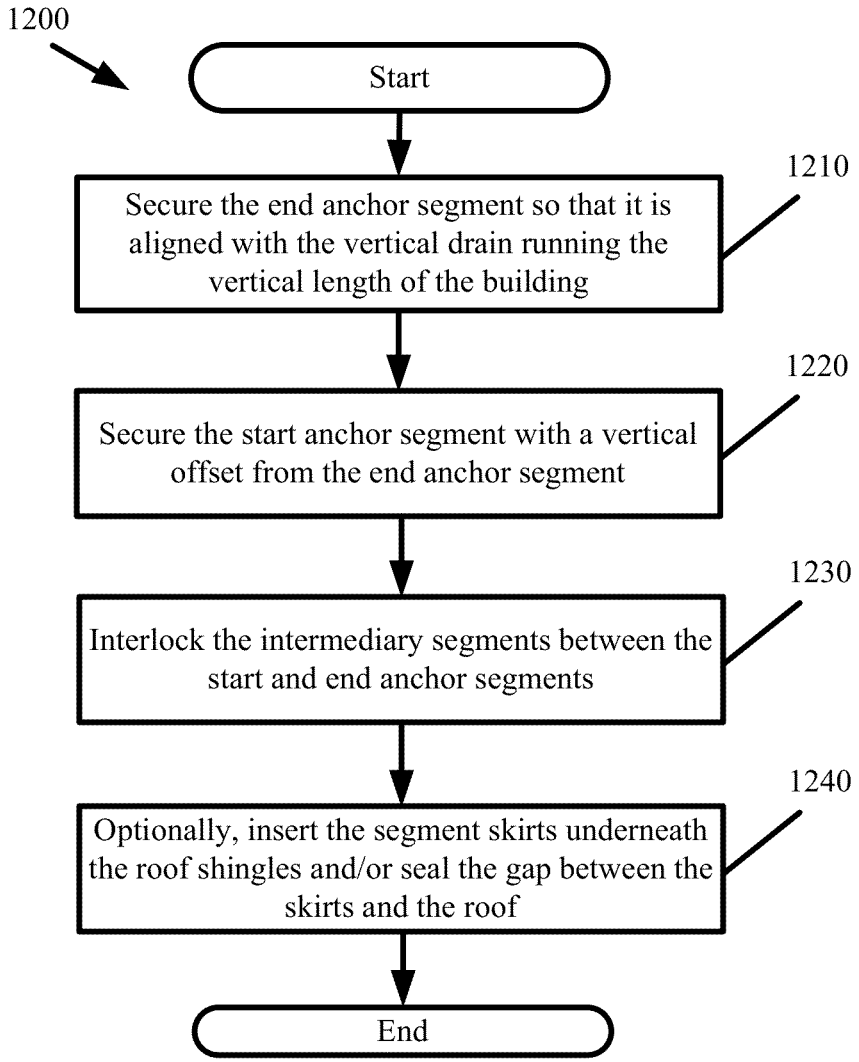
FIG. 12 presents a process summarizing the installation of the gutter system in accordance with some embodiments.

FIG. 12 presents a process 1200 summarizing the installation of the gutter system in accordance with some embodiments. Typically a first step in the process is to secure (at 1210) the end anchor segment so that it is aligned with the vertical drain running the vertical length of the building. Specifically, the end anchor segment is positioned over the vertical drain to allow gravity to direct the collected rain runoff directly into a cup or mouth of the vertical drain. Next, the process involves securing (at 1220) the start anchor segment with a vertical offset from the end anchor segment. Securing the anchor segments involves hammering a nail through the receptacles of the anchor blocks into the roof, screwing the anchor blocks to the roof, or clamping the anchor blocks to the roof as some examples. Next, the installer interlocks (at 1230) the intermediary segments between the start and end anchor segments. The installer may use shorter length intermediary segments when needed to ensure that the full width of the roof is spanned. For example, to span a roof that is 37 feet wide, the installer can use a 5 foot start anchor segment, a 5 foot end anchor segment, 5 intermediary segments that are 5 foot, and 2 intermediary segments that are 1 foot. Optionally, the installer can insert (at 1240) the segment skirts underneath the roof shingles and/or seal the gap between the skirts and the roof. This completes the installation.

Figure 13:
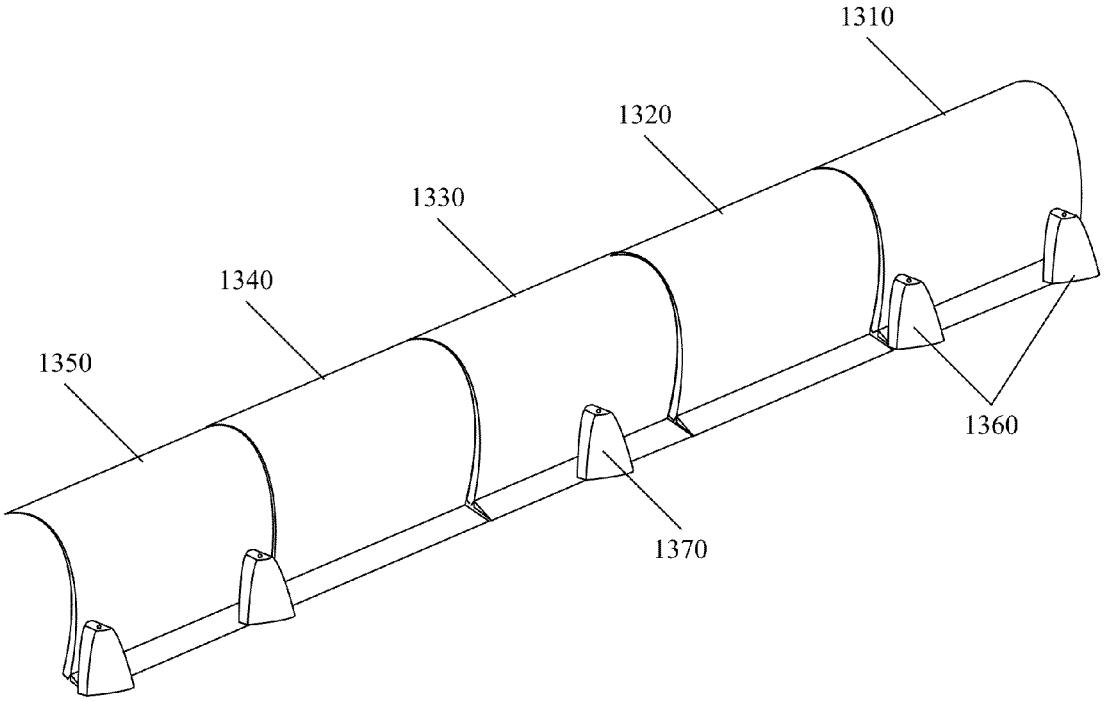
FIG. 13 illustrates a gutter comprised of five of the interlocking segments.

As noted above, one enhancement that can be made to the design includes providing different length intermediary segments to allow installers to easily adjust the length of the gutter to the roof width. Another enhancement includes providing one set of intermediary segments that have an anchor block behind and in the middle of the segment and another set of intermediary segments that do not have an anchor block. The intermediary segments with the anchor block can be secured to the roof in the same manner as the anchor segments. These enhanced intermediary segments are intended to be interspersed between other intermediary segments that do not include the anchor block as a means of providing additional rigidity to the gutter if desired. The intermediary segments with the anchor blocks may be desired in areas that experience heavy rainfall, wherein the additional rigidity afforded by these segments can offset the force and weight of the aggregate rainfall against the segments. FIG. 13 illustrates a gutter comprised of five segments 1310, 1320, 1330, 1340, and 1350. Segment 1310 is the start anchor segment and is shown with two anchor blocks 1360 that fix the position and angle of that segment. Segments 1320 and 1340 are intermediary segments that do not include an anchor block. Segment 1320 is therefore held in place because of the interlocking with segment 1310 and 1330. Segment 1330 is an intermediary segment that does include an anchor block 1370. The anchor block 1360 secures the segment to the roof, thereby providing segment 1330 with additional support as well as providing the interlocked segments 1320 and 1340 additional support. Finally, segment 1350 is the end anchor segment shown with two anchor blocks.

I claim:

1. A rain gutter system comprising:

a plurality of interlocking gutter segments, each gutter segment of the plurality of interlocking gutter segments comprising:

(i) a first leg and a second leg joined at a top end and separated at an opposite bottom end by a distance;

(ii) a non-permeable membrane covering at least the first leg and comprising a skirt extending a specified distance below the bottom end of the first leg and flexing about perpendicular to the first leg;

(iii) a male coupler of a male-female coupling mechanism disposed on one lateral end of at least one of the first leg and the second leg; and (iv) a female coupler of the male-female coupling mechanism disposed on an opposite lateral end of the leg to where the male coupler is disposed, wherein the male coupler of a first gutter segment couples to the female coupler of a second gutter segment to interlock the first gutter segment with the second gutter segment with the non-permeable membranes from the first and second gutter segments overlapping.

2. The rain gutter system of claim 1, wherein at least one of the plurality of interlocking gutter segments comprises a receptacle attached to a backside of the second leg, the receptacle comprising a column with a vertical cavity adapted to receive a nail or screw to secure the gutter segment atop a surface over which the gutter segment is situated.

3. The rain gutter system of claim 2, wherein at least another of the plurality of interlocking gutter segments comprises a funnel that is adapted to redirect water from a horizontal face of the gutter segment to a vertical drain.

4. The rain gutter system of claim 1, wherein the plurality of interlocking gutter segments are configured to stand atop shingles of a roof with the skirt of each segment flexing about parallel with the shingles.

5. The rain gutter system of claim 4, wherein the plurality of interlocking gutter segments form a non-permeable channel by redirecting rain runoff flowing vertically over the roof shingles onto the skirt and horizontally across the non-permeable channel rather than underneath and behind the plurality of interlocking gutter segments.

6. The rain gutter system of claim 1, wherein the non-permeable membrane further comprises a curved tip extending over the top end of the first leg and curving away from the second leg.

7. The rain gutter system of claim 1, wherein the skirt is adapted for insertion underneath a roof shingle, and wherein insertion of the skirt underneath the roof shingle creates a seal that redirects water flowing vertically over the shingle horizontally across a width of the first leg preventing said water from flowing underneath and behind the skirt.

8. A gutter system comprising:

a plurality of interlocking segments, each particular segment comprising:

(i) an inverted "V" shaped frame configured to support the entirety of the particular segment about perpendicularly atop a roof;

(ii) a male coupler of a male-female coupling assembly disposed at one lateral side of the frame and a female coupler of the male-female coupling assembly disposed at an opposing lateral side of the frame, wherein the male coupler of the particular segment interlocks with the female coupler of a first segment to interlock the particular segment and the first segment together, and wherein the female coupler of the particular segment interlocks with the male coupler of a second segment to interlock the particular segment and the second segment together;

(iii) a non-permeable membrane covering at least a front facing side of the frame, the non-permeable membrane comprising a skirt extending a specified distance below the frame and flexing to be about perpendicular with the frame;

wherein the plurality of interlocking segments form a non-permeable channel in combination with a surface of the roof by placing the plurality of interlocking segments atop shingles of the roof, interlocking the plurality of interlocking segments using the male-female coupling assembly, and inserting the skirt of at least one segment of the plurality of segments underneath at least one roof shingle, wherein the non-permeable channel prevents rain runoff flowing vertically over the roof shingles from passing underneath and behind the plurality of interlocking segments at a position where the plurality of interlocking segment intersect the roof surface.

9. The gutter system of claim 8, wherein at least one segment of the plurality of interlocking segments comprises an anchor block operable to attach the segment to the roof surface with at least one of a nail or screw.

10. The gutter system of claim 9, wherein the anchor block comprises a first receptacle at one lateral end along a backside of the frame and a second receptacle at an opposing lateral end along the backside of the frame, wherein each receptacle comprises a column with a central cavity into which a nail or screw can be driven through.

11. The gutter system of claim 8, wherein the non-permeable membrane is made of at least one of rubber and plastic.

12. The gutter system of claim 11, wherein the frame is made of at least one of metal, aluminum, and plastic.

13. The gutter system of claim 8, wherein the non-permeable channel is a two-sided channel formed by the intersection of the plurality of interlocking segments with the roof surface, wherein the frames of the plurality of interlocking segments establish one side of the two-sided channel, and wherein the roof surface establishes the other side of the two-sided channel.

14. The gutter system of 8, wherein the male coupler is a set of prongs and the female coupler is a set of holes into which the set of prongs are inserted to interlock two segments.

15. The gutter system of claim 8, wherein the male coupler is a protrusion angled toward a specific direction and the female coupler is a complimentary protrusion that is angled toward a direction opposite to that of the specific direction such that the male coupler slides into the female coupler to interlock two segments.

16. The gutter system of claim 8, wherein the male coupler is a protrusion extending from the frame and the female coupler is a cavity embedded within the rigid frame, and wherein the protrusion inserts into said cavity to interlock two segments.

17. An interlocking segment for a gutter system, the interlocking segment comprising:

a rigid framework comprising two facets joined in an inverted "V" shape, the rigid framework providing a base supporting the entirety of the interlocking segment over and about perpendicular a surface of a roof;

an upper non-permeable membrane waterproofing at least one facet of the rigid framework; and a lower non-permeable membrane comprising a skirt extending from the upper non-permeable membrane a specified distance below the rigid framework, wherein the skirt bends to become about parallel with the roof surface and about perpendicular to the rigid framework when the interlocking segment is placed over and about perpendicular to the surface, and wherein the skirt creates a barrier with the roof surface that redirects rain runoff vertically flowing over the roof surface horizontally across the upper non-permeable membrane at the intersection of the upper non-permeable membrane and the roof surface and prevents the rain runoff from flowing underneath and behind the interlocking segment.

18. The interlocking segment of claim 17, wherein the interlocking segment forms a two-sided channel with the roof surface where the interlocking segment is placed over and about perpendicular to the roof surface, wherein one side of the two-sided channel is comprised of a front side of the upper non-permeable membrane and the other side of the two-sided channel is comprised of a portion of the roof surface in front of the interlocking segment such that vertically flowing rain runoff from the roof surface collects in the two-sided channel where it is redirected horizontally across the interlocking segment.

19. The interlocking segment of claim 17, wherein the upper non-permeable membrane covers a front facet of the interlocking segment, the interlocking segment further comprising a pair of receptacles disposed along a rear facet of the interlocking segment, each receptacle of the pair of receptacles comprising a vertical column with a central cavity that is adapted to receive a nail or screw to secure the interlocking segment atop the roof surface.

20. The interlocking segment of claim 17, wherein the upper non-permeable membrane further comprises a curved tip bending in the same direction as the skirt.

* * * * *